US006135062A

United States Patent [19]

Palmers

[11] Patent Number: 6,135,062

[45] Date of Patent: Oct. 24, 2000

[54] STEAM GENERATOR

[75] Inventor: Göran Palmers, Askim, Sweden

[73] Assignee: TSP Medical AB, Göteborg, Sweden

[21] Appl. No.: 09/202,603

[22] PCT Filed: Jun. 16, 1997

[86] PCT No.: PCT/SE97/01052

§ 371 Date: Dec. 17, 1998

§ 102(e) Date: Dec. 17, 1998

[87] PCT Pub. No.: WO97/48947

PCT Pub. Date: Dec. 24, 1997

[30] Foreign Application Priority Data

Jun. 18, 1996 [SE] Sweden ..... 9602396

[51] Int. Cl.[7] ..... F22B 27/00

[52] U.S. Cl. ..... 122/40; 219/401; 392/399

[58] Field of Search ..... 122/40, 449; 219/401; 392/394, 399

[56] References Cited

U.S. PATENT DOCUMENTS 4,288,674 9/1981 Councell ..... 219/401

4,408,116 10/1983 Turner ..... 122/40

5,371,828 12/1994 Ewing ..... 122/40

5,553,188 9/1996 Ewing ..... 122/40

5,949,958 9/1999 Naperkowski et al. ..... 392/399

*Primary Examiner*—Denise L. Ferensic

*Assistant Examiner*—Gregory A. Wilson

*Attorney, Agent, or Firm*—Merchant & Gould P.C.

[57] ABSTRACT

Steam generator of the type incorporating a heating body (13) provided with means (19) for supply of heat to the body and with at least one internal cavity (15) provided with a connection (3) for supply of water, which shall be evaporized and with an outlet (2) for water that has been transferred to steam, whereby the connection (3) of the steam generator for supply of water is provided in the bottom of the cavity (15), and that the steam generator is equipped with a control system (4-12), which permits supply and also discharge of water via the connection (3), and which is adapted to maintain a constant feeding pressure on the water independent of the direction of water flow.

12 Claims, 2 Drawing Sheets

STEAM GENERATOR

BACKGROUND

Today steam is used in many different processes. The steam is produced in different types of steam generators, which have mutually different properties.

Some types of steam generators thus have continuous, whereas other have intermittent steam capacity. Heating can be carried out with electric heating or by combustion of oil or by aid of other energy sources. Due to the specific applications for which the steam generator is intended, and also in view of the expected life span, the size thereof furthermore can vary and also the material from which it is manufactured.

At one type of such steam generators primarily intended for autoclaves is used an aluminium body with an internal cavity. The aluminium body is heated, whereupon water is sprayed into the cavity in the body, and is vaporized at contact with the body.

A drawback of this solution is that the steam pressure is controlled in dependence of the water volume sprayed in. If too much water is sprayed into the cavity, the pressure will become too high. The temperature of the body can not be lowered too much, as all the water in such case can not be vaporized immediately, but water will remain in the cavity and after boil. In order to prevent this the body must be made heavy. Simultaneously this solution requires that the steam generator is equipped with spraying nozzle and has a connection to water of high pressure.

At another solution is used a water container, which is heated to high temperature, whereby the water is used for storing the energy. A water container for such a steam generator must be built for high pressure, as water of higher temperature gives higher pressure. Furthermore it is a drawback, that the steam delivered has high pressure and high temperature, which can involve control technical problems at the place of use.

At still another earlier solution direct electric steam generation is brought about by means of electrodes, whereby the steam generation can be controlled either via the water level in the steam generator or via the electric current applied.

A drawback with this solution is that energy storing is effected only in the form of steam, and it furthermore is not possible to use de-ionizised water, as this has a too low conductivity.

SE-C-161.717 describes a steam generator having a heating element with an internal cavity to which water from above is supplied in a coil positioned in the cavity and equipped with an internal heating coil, and with a restricted water outlet situated a short distance above the bottom of the vessel, and an outlet for overheated steam provided at the upper part. Due to this design of the vessel the flow control of water will be made difficult, at the same time as the steam generator requires a rather large quantity of supplied heat due to the necessity to heat water, cause it to evaporize and furthermore to overheat the steam produced.

SUMMARY

The purpose of the present invention is to provide a steam generator, which is intended to provide steam to a very small autoclave, whereby the steam generator shall be small and light, at the same time as it has capacity momentarily to discharge high effect also with a limited electric connecting effect. It furthermore always shall be able to give a correct steam pressure, as the autoclave in which the steam primarily shall be used is very small in itself.

Finally it shall operate with pure water and it is furthermore a desire, that it shall be inexpensive to manufacture.

These properties are achieved in that the steam generator has been given the features defined in the accompanying claims.

BRIEF DESCRIPTION OF THE DRAWINGS

Hereinafter the invention will be described with reference to an embodiment shown in the accompanying drawings.

DETAILED DESCRIPTION

Figure 1:
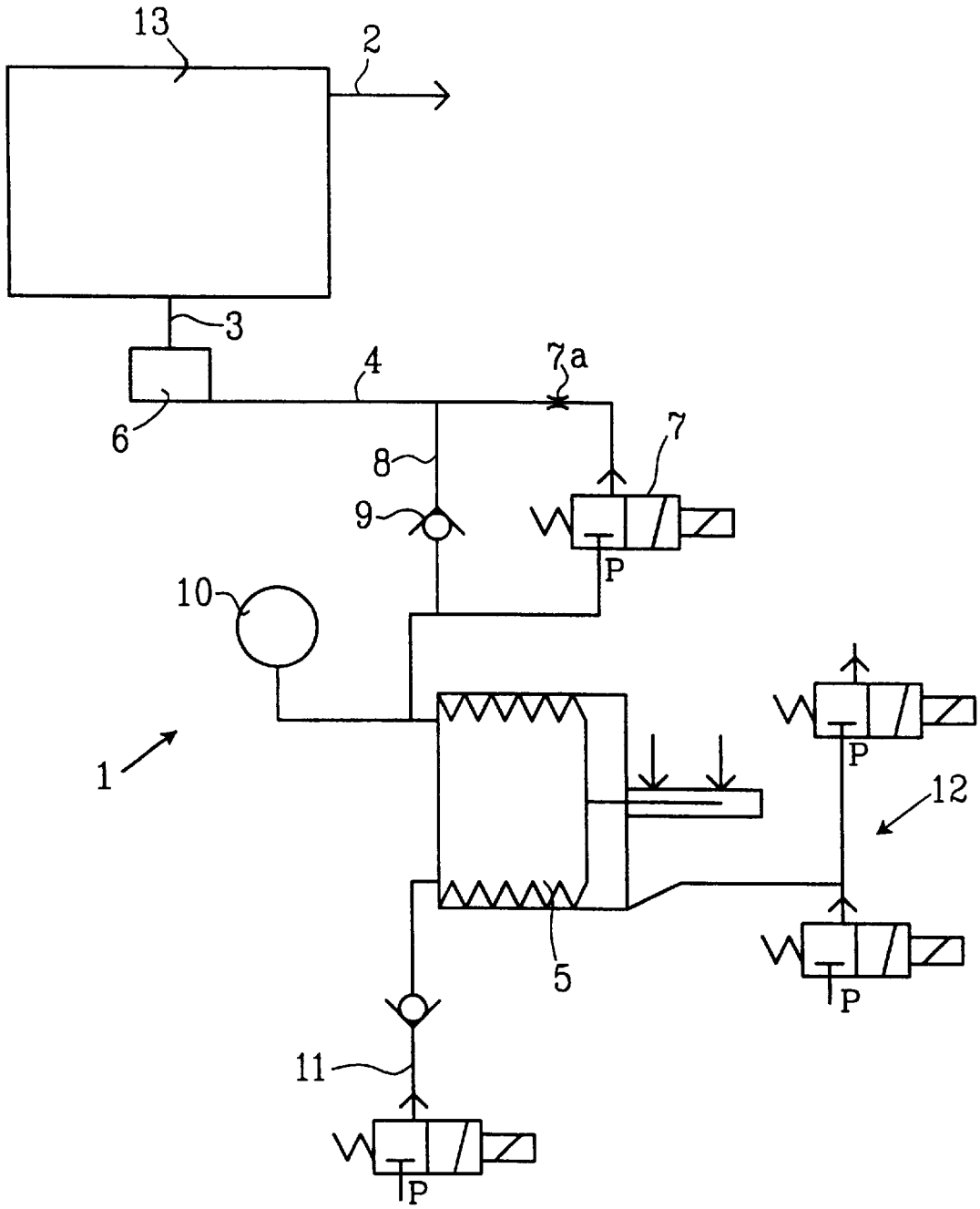
FIG. 1 shows a circuit diagram with a steam generator according to the invention and components connected thereto for supply of water to the steam generator.

FIG. 1 shows schematically a steam generator 1, having a steam generating chamber 13, shown as block, and which is provided with a steam outlet 2. In the lower part of the steam generating chamber 13 is provided a connection 3 for supply of water via a conduit 4 from a tank 5 maintaining a constant pressure and also for discharging water to a return tank 6.

In the conduit 4 is provided an operating valve 7, with a restriction 7*a* arranged in series therewith, whereas a return conduit 8 having a non-return valve 9 arranged therein is connected to the conduit 4, thus that it bridges the restriction 7*a* and the operating valve 7. The flow control formed in this manner is preferably a constant flow control. The tank 5 maintaining a constant pressure in turn is connected to a pressure sensor 10, and to a valve controlled water connection 11. The pressure maintaining tank 5 is equipped with a valve arrangement 12 for controlling pressure in and supply of water to the steam generating chamber.

Figure 2:
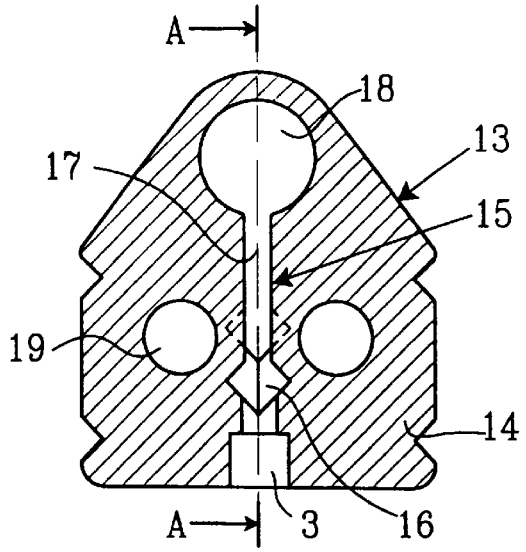
FIG. 2 is a cross section through the very steam generator along line B—B in FIG. 3.
Figure 3:
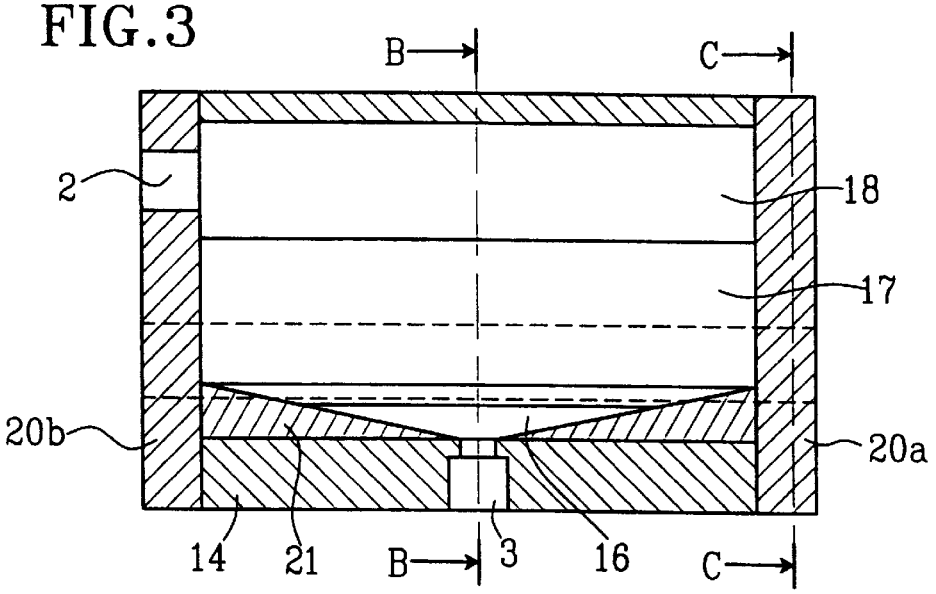
FIG. 3 shows a longitudinal section through the steam generator according to the invention, along line A—A in FIG. 2.
Figure 4:
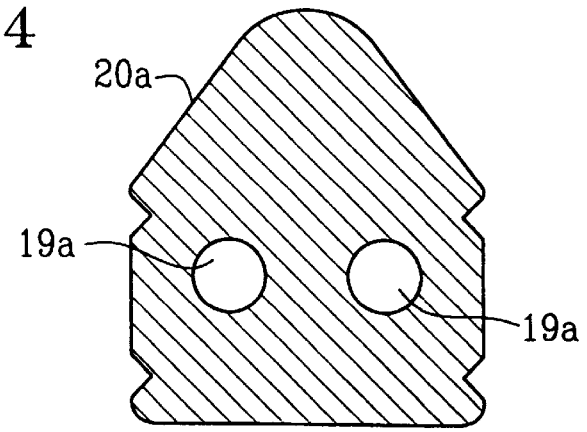
FIG. 4 shows a longitudinal section along line C—C in FIG. 3.

FIGS. 2–4 show in different sections, the very steam generating chamber, schematically and without connections and heating means.

Thus in FIG. 2 is shown a cross section along line B—B in FIG. 3, through a heating body 13 acting as a steam generating chamber in the steam generator 1, whereas FIG. 3 shows a longitudinal section along line A—A in FIG. 2, and FIG. 4 shows a cross section along line C—C in FIG. 3.

In the embodiment shown, the heating body 13 consists of a extruded profile 14, preferably of aluminium, or another material having similar heat conducting properties. In the non-limiting embodiment shown, extends in longitudinal direction through the profile, a centrally located, substantially keyhole-shaped steam generating chamber 15, with a lower portion 15 communicating with the inlet connection 3, a narrow, substantially vertically arranged slot-formed portion 17 and an upper, bigger portion 18, to which the steam outlet 2 is connected. Further through the profile extend also channels 19 for accommodating not shown electric immersion heaters or for permitting through-flow of a heating medium. In the example shown, the heating chamber is closed off at the gables by means of preferably soldered, preferably extruded gables 20*a, b,* in the embodiment shown (20*a* in FIG. 4) equipped with channels 19*a,* corresponding to the channels 19 for heating purposes. In the opposite gable 20*b* there is further and/or an opening for the steam outlet 2. The heating body can furthermore also otherwise consist of parts preferably interconnected by soldering.

Internally the steam generating chamber 15 is equipped with inserts 21, by means of which the bottom of the lower portion 16 slopes in a direction towards the centrum inlet and outlet 3 for water.

At operation the heating body 13, manufactured of aluminium or the like, is first heated to a temperature, high above the vaporization temperature of the water in order to store energy.

When correct temperature has been reached water is introduced through the connection 3 from the bottom of the lower portion 16 in the steen generating chamber under control of the valve 7. The water raises up through the slot-formed portion 17, wherein the water is evaporized, mainly by contact with the sides of the slot.

As the slot walls are hot, there is a risk that the heat transfer is obstructed by the so called Leidenfrost effect, but this can be avoided in two different manners. For this purpose the slot walls may have a coating, which has a capillary effect and a lower coefficient of thermal conductivity than the material of the very heating body 13. Hereby the water does not form a gas film on the coating surface but can be conducted via the capillary effect into the metal. The same effect can be obtained in that the wall is equipped with not shown ridges projecting inwardly towards the centre line of the slot, and which are cooled at different speed at the crests and at the bottoms of the ridges, and for this reason there are always positions between the crest and bottom, which has an appropriate temperature for evaporization. As the evaporization is effected on vertical faces, the gas film which reduces the thermal transfer is broken up more easily.

Due to the good thermal conductivity of the material such as aluminium, used for the heating body 13, the energy stored in the heating body can transfer water into steam very rapidly. For ascertaining that the steam generator is not overloaded, and thereby becoming cooled, thus that water will leave the steam generator 1 through the steam outlet 2, the water level in the slot-formed portion 17 is controlled. When the water level has raised to the highest permitted level, the inlet valve 7 is closed. This supervision can be achieved via temperature measurement in the area of the slot. When the temperature again has been raised to a desired level and the water therefore has sunk in the slot, the valve 7 is again opened.

The steam pressure is maintained in that the steam generator is fed at a predetermined water pressure via cooperation between the valve 7, the restriction 7*a* and the non-return valve 9, and with pressurization from the pressure chamber 5. As long as the steam consumption is higher than the capacity of the generator, the steam consumption will control the water level in the steam generating chamber.

When tapping of steam is reduced or is shut off completely, the water due to the prevailing pressure is pressed back to the pressure maintaining tank 5 via the connection 3, the return tank 6, the conduit 4 and the valve 7, which normally always is open. As the bottom of the steam generating chamber due to the inserts 21 slopes towards the outlet 3 all water will safely flow out and will not stay in any pockets or the like. Even in case the valve 7 is closed, the water in the steam generating chamber will be drained via the conduit 8 and the non-return valve 9.

The fact that the shut-off steam generator is dry reduces the risk for corrosion.

The invention is not limited to the embodiment illustrated in the drawing and described in connection thereto but variants and modifications are possible within the scope of the accompanying claims.

What is claimed is:

1. Steam generator comprising a heating body provided with means for supply of heat to the body and with at least one internal cavity provided with a connection for supply of water which shall be evaporized and with an outlet for water that has been transferred to steam, the connection of the steam generator for supply of water is provided in the bottom of the cavity, and including a control system which permits supply and also discharge of water via the connection and which is adapted to maintain a constant feeding pressure on the water independent of the direction of water flow.

2. Steam generator as claimed in claim 1, wherein the control system incorporates means for flow control of the water supply to the internal cavity of the heating body from the water outlet provided in the heating body.

3. Steam generator as claimed in claim 1 or 2, wherein the outlet is provided with a drain valve for draining of the cavity of the heating body when the control system is shut off.

4. Steam generator as claimed in claim 1, wherein the cavity of the heating body has a bottom sloping towards the outlet connection.

5. Steam generator as claimed in claim 1, wherein the cavity of the heating body has a portion with substantially vertical surfaces, via which substantial heat transfer for evaporization between the heating body and the water takes place.

6. Steam generator as claimed in claim 5, wherein the cavity of the heating body has a very small volume in the portion where evaporation takes place, as compared to the volume of the heating body, whereby only a small volume of water has to be heated for evaporation, and whereby the volume of heated return water, which via the outlet might leave the chamber, will become small.

7. Steam generator as claimed in claim 5 or 6, wherein the surfaces at least of the main steam generating portion of the heating body has a porous coating with lower thermal conductivity than the material in the heating body.

8. Steam generator as claimed in anyone of claims 5–6, wherein the walls of the cavity of the heating body at least in the portion where evaporization takes place, is equipped with inwardly projecting ridges adapted always to provide a suitable zone for evaporization of the water, as the crests and the bottoms of the ridges are cooled differently.

9. Steam generator as claimed in anyone of the preceeding claims 1 or 2, wherein means for supervision of the temperature of the wall of the evaporization portion of the cavity are arranged in the vicinity of the connection in order to determine the water level in the cavity.

10. Steam generator as claimed in anyone of the preceeding claims 1 or 2, wherein in connection to the outlet from the cavity of the heating body is provided a return tank having a volume adapted for storing of heated water, which flows out of the cavity.

11. Steam generator as claimed in anyone of the preceeding claims 1 or 2, wherein the heating body is extruded.

12. Steam generator as claimed in anyone of the preceeding claims 1 or 2, wherein the heating body consists of parts interconnected by soldering.

* * * * *